US009061502B2

(12) United States Patent
Yamazaki

(10) Patent No.: US 9,061,502 B2
(45) Date of Patent: Jun. 23, 2015

(54) LIQUID EJECTING APPARATUS

(71) Applicant: Seiko Epson Corporation, Shinjuku-ku (JP)

(72) Inventor: Toshinobu Yamazaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/225,277

(22) Filed: Mar. 25, 2014

(65) Prior Publication Data

US 2014/0292885 A1 Oct. 2, 2014

(30) Foreign Application Priority Data

Mar. 28, 2013 (JP) ..... 2013-070724
Jan. 8, 2014 (JP) ..... 2014-001964

(51) Int. Cl.

| | |
|---|---|
| ***B41J 29/38*** | (2006.01) |
| ***B41J 2/165*** | (2006.01) |
| ***B41J 2/045*** | (2006.01) |
| ***B41J 11/00*** | (2006.01) |
| ***B41J 2/24*** | (2006.01) |
| ***B41J 2/14*** | (2006.01) |

(52) U.S. Cl.

CPC ..... *B41J 2/165* (2013.01); *B41J 2/04563* (2013.01); *B41J 11/002* (2013.01); *B41J 2/16535* (2013.01); *B41J 2002/16564* (2013.01); *B41J 2/24* (2013.01); *B41J 2/0454* (2013.01); *B41J 2/04553* (2013.01); *B41J 2/04581* (2013.01); *B41J 2/04596* (2013.01); *B41J 2/14274* (2013.01); *B41J 2/16526* (2013.01); *B41J 2/16532* (2013.01); *B41J 2002/16567* (2013.01); *B41J 2002/16573* (2013.01)

(58) Field of Classification Search

CPC ..... B41J 2/165; B41J 2/24; B41J 2/16535; B41J 11/002; B41J 2/04563; B41J 2002/16564
See application file for complete search history.

(56) References Cited

U.S. PATENT DOCUMENTS

2011/0249050 A1* 10/2011 Ozawa et al. ..... 347/10
2012/0249639 A1 10/2012 Ozawa et al.

FOREIGN PATENT DOCUMENTS

JP 09-193408 A 7/1997
JP 2005-186500 A 7/2005
JP 2012-218169 A 11/2012

* cited by examiner

*Primary Examiner* — Julian Huffman
(74) *Attorney, Agent, or Firm* — Kilpatrick Townsend & Stockton LLP

(57) ABSTRACT

A liquid ejecting apparatus includes a head that ejects an ink from a nozzle opening; a moving unit that moves the head; and a heating unit that sets a temperature of a recording sheet onto which the ink is ejected from the head. Before the head ejects the ink onto the recording sheet, the moving unit is moved, and the head is moved to a position opposing a platen and an upper heater, which is a position to where heat radiated from the heating unit is transferred.

15 Claims, 13 Drawing Sheets

LIQUID EJECTING APPARATUS

CROSS REFERENCES TO RELATED APPLICATIONS

This application claims priority to Japanese Patent Application No. 2013-070724 filed on Mar. 28, 2013, and Japanese Patent Application No. 2014-001964 filed on Jan. 8, 2014. The entire disclosure of Japanese Patent Application Nos. 2013-070724 and 2014-001964 are hereby incorporated herein by reference.

BACKGROUND

1. Technical Field

The present invention relates to a liquid ejecting apparatus, and particularly relates to an ink jet recording apparatus which ejects an ink as a liquid.

2. Related Art

A representative example of a liquid ejecting apparatus including a liquid ejecting head which ejects liquid droplets includes an ink jet recording apparatus including an ink jet recording head which ejects ink droplets.

An ink ejected from the ink jet recording head has viscosity suitable for ejection depending on types of ink. The viscosity of the ink is correlated with temperature. Thus, in general, there are characteristics that the viscosity increases as the temperature decreases and the viscosity decreases as the temperature increases. Therefore, when correction of a drive signal is performed based on a detection temperature of a temperature sensor, temperature detection and the correction of the drive signal are performed until the detection temperature of the temperature sensor is in a steady state, each time the ink jet recording head moves from end to end in a main scanning direction.

JP-A-2012-218169 is an example of related art.

However, even if frequency of the temperature detection is increased, in a non-steady state where the ink is heated up to a predetermined temperature, a difference between an actual ink temperature and an ink temperature detected by the temperature sensor is not constant. In particular, as the temperature sensor becomes farther separated from the vicinity of a nozzle which greatly influences ejection properties of the ink, variations in the above-described temperature difference increase. That is, in the non-steady state, it is difficult to accurately grasp the ink temperature by using the temperature sensor.

This problem is similarly present not only in the ink jet recording apparatus, but also in the liquid ejecting apparatus which ejects the liquid other than the ink.

SUMMARY

An advantage of some aspects of the invention is to provide a liquid ejecting apparatus which can improve ejection quality by reducing a possibility that liquid ejection properties may be worsened due to a temperature change when a liquid is ejected.

According to an aspect of the invention, there is provided a liquid ejecting apparatus including a liquid ejecting head that ejects a liquid from a nozzle opening; a moving unit that relatively moves the liquid ejecting head; a temperature setting unit that has a support member supporting a recording medium onto which the liquid is ejected from the liquid ejecting head, and that sets a temperature of the support member or the recording medium supported by the support member; and a controller that drives the moving unit before the liquid ejecting head ejects the liquid onto the recording medium, that moves the liquid ejecting head to a temperature setting position where heat radiated from the temperature setting unit is transferred to the liquid ejecting head, and that uses the temperature setting unit so as to perform temperature setting on the liquid ejecting head.

In this case, before the liquid is ejected from the liquid ejecting head, the head is moved to the temperature setting position and the temperature setting is performed by the temperature setting unit. That is, prior to the ejection of the liquid, the liquid ejecting head is moved close to the temperature setting unit to perform the temperature setting. In this manner, it is possible to shorten a time period required until the temperature of the liquid inside the liquid ejecting head reaches a predetermined temperature so as to be in a steady state. Then, the temperature of the liquid inside the liquid ejecting head is in the steady state and there is no more variation. Therefore, it is possible to accurately obtain an actual temperature of the liquid based on a temperature measurement value of the liquid of the liquid ejecting head. In this manner, if a drive signal is corrected based on the temperature measurement value, it is possible to correct the drive signal to be most suitable for an actual viscosity of the liquid. This enables ejection properties of the liquid to be improved, thereby improving ejection quality.

In the liquid ejecting apparatus, it is preferable that a gap between a nozzle surface having the nozzle openings of the liquid ejecting head and the recording medium when the temperature setting unit performs the temperature setting on the liquid ejecting head be smaller than the gap of when the liquid ejecting head ejects the liquid onto the recording medium. In this case, the gap of when the liquid is ejected is greater than that of when the temperature setting is performed. Accordingly, even when the recording medium is bent, it is possible to prevent the recording medium from coming into contact with the nozzle surface of the liquid ejecting head. In contrast, when the temperature setting is performed, the gap is smaller than the gap of when the liquid is ejected. That is, the liquid ejecting head is close to the support member. Therefore, it is possible to perform the temperature setting by more efficiently transferring the heat radiated from the support member to the liquid ejecting head.

In the liquid ejecting apparatus, it is preferable that in a ratio of a time period when the liquid ejecting head stays at the temperature setting position to a time period required for one pass which represents an operation where the liquid ejecting head moves relative to the recording medium, one pass of when the temperature setting unit performs the temperature setting on the liquid ejecting head be longer than one pass of when the liquid ejecting head ejects the liquid onto the recording medium. In this case, when the liquid is ejected, the liquid ejecting head can be moved to eject the liquid within a shorter time as compared with when the temperature setting is performed. Therefore, it is possible to improve an amount of the liquid which can be ejected per unit time. In addition, when the temperate setting is performed, the liquid ejecting head can stay longer at the temperature setting position as compared with when the liquid is ejected. Therefore, it is possible to improve a heating effect of the liquid ejecting head.

In the liquid ejecting apparatus, it is preferable that the liquid ejecting head be stopped at the temperature setting position when the temperature setting unit is used in performing the temperature setting on the liquid ejecting head. In this case, it is possible to cause the liquid ejecting head to stay longer at the temperature setting position. Therefore, it is possible to further improve a temperature setting effect of the liquid ejecting head.

In the liquid ejecting apparatus, it is preferable that the maximum speed of when the temperature setting is performed on the liquid ejecting head be slower than the maximum speed of when the liquid ejecting head relatively moves while ejecting the liquid onto the recording medium. In this case, when the liquid is ejected, the liquid ejecting head can be moved faster to eject the liquid as compared with when the temperature setting is performed. Therefore, it is possible to improve an area of the liquid which can be ejected per unit time. In addition, when the temperature setting is performed, the liquid ejecting head is moved slower at the temperature setting position as compared with when the liquid is ejected. Therefore, it is possible to further improve the temperature setting effect of the liquid ejecting head.

In the liquid ejecting apparatus, it is preferable that a first speed difference between a moving speed at the temperature setting position when the liquid ejecting head ejects the liquid and a moving speed at the temperature setting position when the temperature setting is performed on the liquid ejecting head be greater than a second temperature difference between a moving speed in a region other than the temperature setting position when the liquid ejecting head ejects the liquid and a moving speed in the region other than the temperature setting position when the temperature setting is performed on the liquid ejecting head. In this case, by causing the first speed difference to be greater than the second speed difference at the temperature setting position, when the temperature setting is performed, the liquid ejecting head can be moved faster to eject the liquid as compared with when the temperature setting is performed. Therefore, it is possible to improve the amount (area) of the liquid which can be ejected per unit time. In addition, in the region other than the temperature setting position, even when the temperature setting is performed, by causing the first speed difference to be greater than the second speed difference, the liquid ejecting head can be moved at the speed which is the same as that of when the liquid is ejected. In this manner, it is possible to perform the temperature setting by quickly moving the liquid ejecting head to the temperature setting position. Therefore, it is possible to shorten the time period required from when the temperature setting is performed until the liquid ejection is started.

In the liquid ejecting apparatus, it is preferable that the number per unit time of departures from the temperature setting position when the temperature setting is performed on the liquid ejecting head be less than the number per unit time of departures from the temperature setting position when the liquid ejecting head ejects the liquid. In this case, when the temperature setting is performed, the liquid ejecting head is enabled to stay longer at the temperature setting position. Therefore, the temperature of the liquid ejecting head is enabled to quickly reach a predetermined temperature.

In the liquid ejecting apparatus, it is preferable that the temperature setting unit include the support member and an upper heater that is arranged to be further separated in a direction opposite to the support member than the liquid ejecting head, and that heats the support member or the recording medium supported by the support member, and that the temperature setting position be a position opposing the upper heater. In this case, it is possible to perform the temperature setting on the liquid ejecting head by using the heat generated by the upper heater.

In the liquid ejecting apparatus, it is preferable that the temperature setting position be a position opposing the support member. In this case, it is possible to perform the temperature setting on the liquid ejecting head by using the heat generated by the support member.

In the liquid ejecting apparatus, it is preferable that the temperature setting unit include the support member and a heater that heats the support member from an opposite side to a support surface side which supports the recording medium of the support member, and that the temperature setting position be a position opposing the heater. In this case, it is possible to perform the temperature setting on the liquid ejecting head by using the heat generated by the heater arranged at the opposite side to the support surface of the support member.

In the liquid ejecting apparatus, it is preferable that the temperature setting position be a position opposing a region where the recording medium having the maximum size which enables the liquid ejecting apparatus to eject the liquid occupies the support member. In this case, it is possible to efficiently perform the temperature setting on the liquid ejecting head by using the heat radiated from the recording medium in which the temperature setting is performed by the temperature setting unit.

In the liquid ejecting apparatus, it is preferable that the controller cause the liquid ejecting head to perform a flushing operation where the liquid is ejected from the nozzle openings, after the temperature setting is performed on the liquid ejecting head. In this case, it is possible to more reliably discharge the liquid by using the flushing operation.

In the liquid ejecting apparatus, it is preferable that the controller perform micro-vibration on a meniscus of the liquid which is formed in the nozzle opening of the liquid ejecting head, after the temperature setting is performed on the liquid ejecting head. In this case, the vibration of the meniscus which is caused by the micro-vibration waveform enables the liquid in a flow channel to be more excellently agitated.

In the liquid ejecting apparatus, it is preferable that the liquid ejecting apparatus further include an absorption unit that absorbs the liquid from the nozzle openings of the liquid ejecting head, and that the controller cause the absorption unit to absorb the liquid from the nozzle openings of the liquid ejecting head, after the temperature setting is performed on the liquid ejecting head. In this case, it is possible to facilitate the discharge of the liquid by using the absorption unit.

In the liquid ejecting apparatus, it is preferable that the liquid ejecting apparatus further include a wiping unit that wipes a nozzle surface having the nozzle openings of the liquid ejecting head, and that the controller cause the wiping unit to wipe the nozzle surface of the liquid ejecting head, after the temperature setting is performed on the liquid ejecting head. In this case, it is possible to more effectively wipe out the liquid by using the wiping unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

The invention will be described in detail based on an embodiment. An ink jet recording head is an example of a liquid ejecting head, and is simply referred to as a head. An ink jet recording apparatus is an example of a liquid ejecting apparatus.

Figure 1:
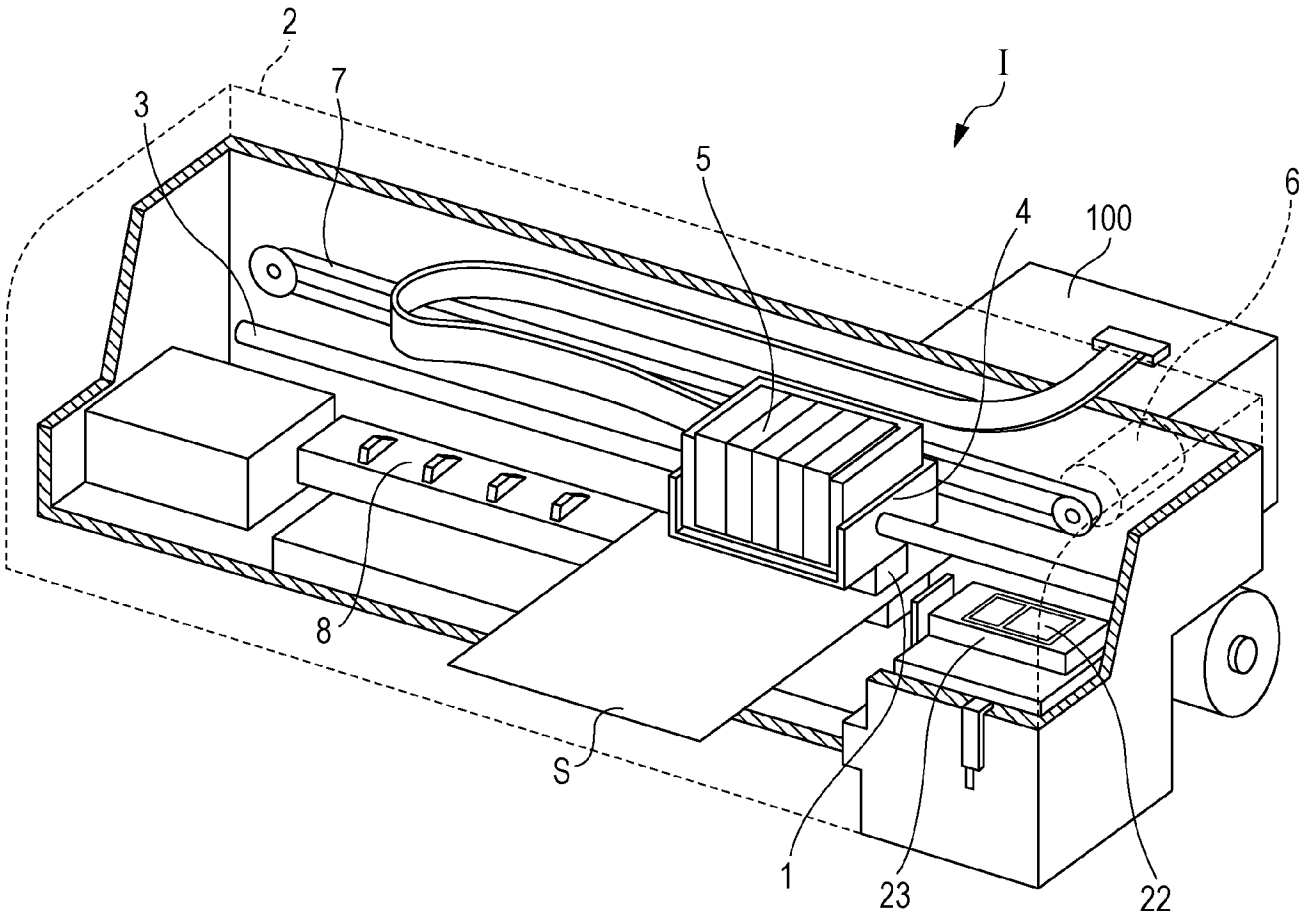
FIG. 1 is a perspective view illustrating an ink jet recording apparatus.
Figure 2:
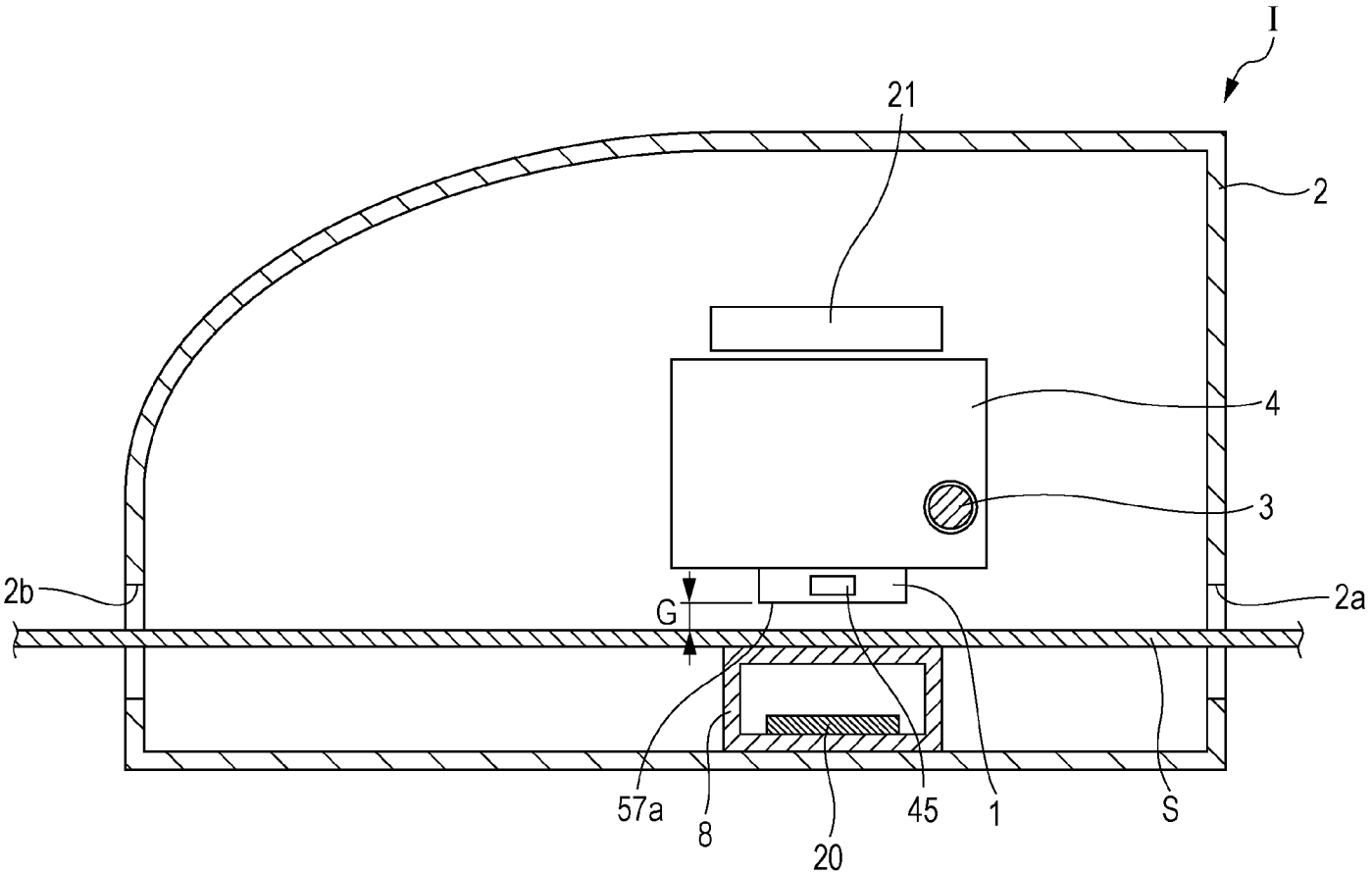
FIG. 2 is a schematic side view illustrating an interior of the ink jet recording apparatus.
Figure 3A:
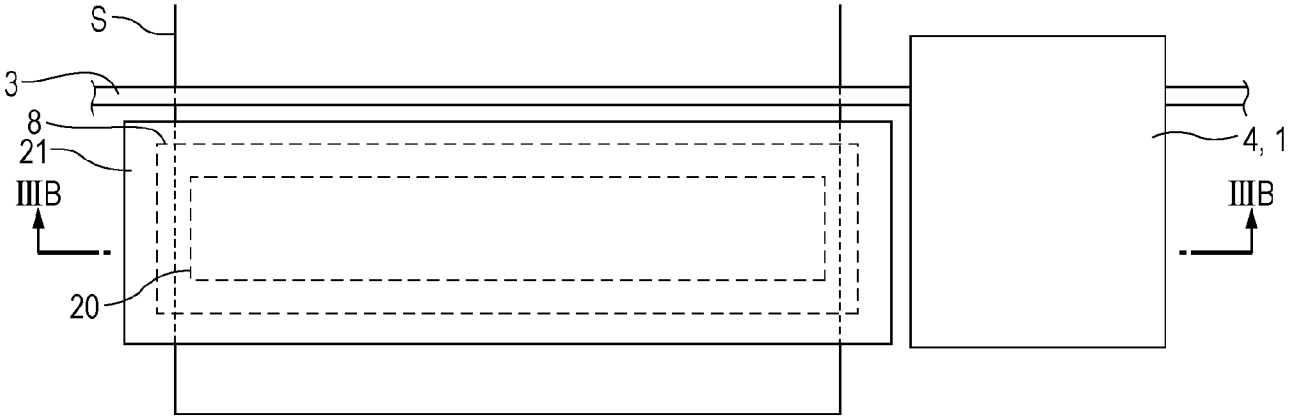
FIGS. 3A and 3B are a top view and a cross-sectional view which illustrate a configuration of a heating unit according to a first embodiment.
Figure 3B:
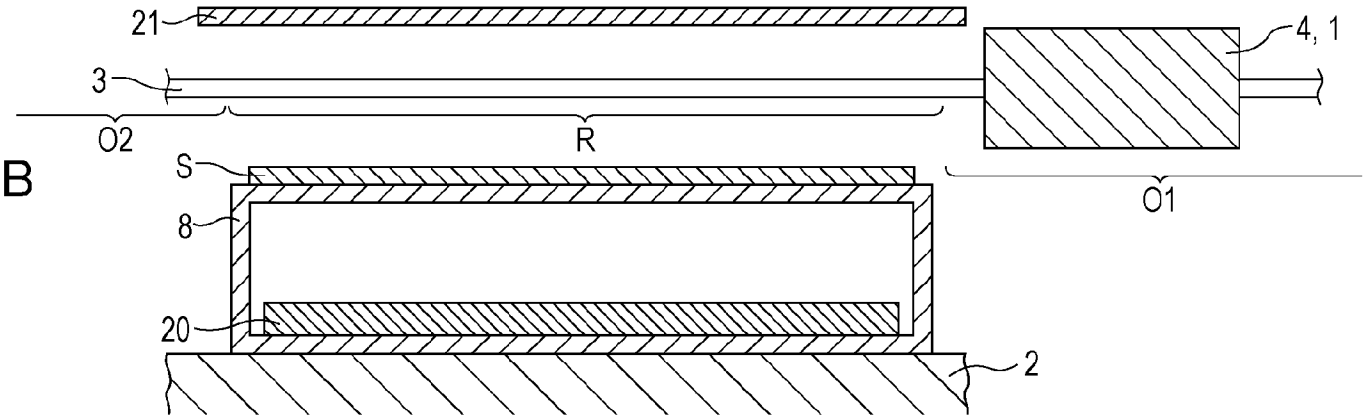

FIG. 1 is a schematic perspective view illustrating the ink jet recording apparatus. FIG. 2 is a schematic side view illustrating an interior of the ink jet recording apparatus. FIG. 3A is a top view illustrating a configuration of a heating unit, and FIG. 3B is a cross-sectional view taken along line IIIB-IIIB in FIG. 3A. An ink jet recording apparatus I according to the present embodiment includes an apparatus body 2, and a carriage shaft 3 extending in one direction is disposed in the apparatus body 2. A carriage 4 which is reciprocally movable along an axial direction (main scanning direction) is attached to the carriage shaft 3. A head 1 and an ink cartridge 5 are mounted on the carriage 4.

A part of the apparatus body 2 is illustrated by a dotted line in FIG. 1 so as to illustrate an internal state of the apparatus body 2. The apparatus body 2 has a hollow box shape, and includes a sheet feeding port 2*a* which feeds a recording sheet S as a recording medium such as paper and a sheet discharge port 2*b*.

A drive motor 6 serving as a moving unit and a timing belt 7 are disposed in the apparatus body 2. The timing belt 7 is attached to the drive motor 6 and the carriage 4, and drive force of the drive motor 6 is transmitted to the carriage 4 by the timing belt 7. The drive of the drive motor 6 causes the carriage 4 to reciprocally move along the carriage shaft 3.

A heating unit serving as an example of a temperature setting unit is disposed in the apparatus body 2. The heating unit is a device which sets a temperature of the head 1 by heating a support member which supports the recording sheet S or the recording sheet S supported by the support member.

The heating unit according to the embodiment includes a platen 8, a platen heater 20 and an upper heater 21. The platen heater 20 and the upper heater 21 heat the platen 8 or the recording sheet S supported by the platen 8. In addition, the platen 8 is an example of the support member.

The platen 8 is formed to have a planar upper surface (surface of the recording sheet S side), and is a member in which an interior thereof is formed in a hollow shape. The platen 8 is arranged along the carriage shaft 3 inside the apparatus body 2. The recording sheet S fed by a sheet feeding roller (not illustrated) is wound around the platen 8, and is transported in a direction orthogonal to the carriage shaft 3 (sub-scanning direction).

In addition, even though not particularly illustrated, the platen 8 is supported by the apparatus body 2 so as to be movable in a vertical direction (direction orthogonal to the main scanning direction and the sub-scanning direction). Since the platen 8 is vertically movable, a paper gap G (corresponding to the gap in claims) which is a gap between the recording sheet S placed on the platen 8 and a nozzle surface 57*a* (surface of a nozzle plate 57 having nozzle openings 56 (to be described later)) of the head 1 can be located at a desired height. Instead of the platen 8, the head 1 may be vertically moved.

The platen heater 20 (an example of the heater in claims) is arranged inside the platen 8. The platen heater 20 heats the platen 8 from an opposite side of the platen 8 to the head 1. In response to execution of a printing process, the platen heater 20 heats the platen 8, heats the recording sheet S via the heated platen 8, and quickens drying of the ink landed on a surface of the recording sheet S. Then, the platen 8 heated by the platen heater 20 according to the embodiment or the recording sheet S supported by the platen 8 further heats the head 1. That is, the platen heater 20 is also used in indirectly heating the head 1. The heating of the head 1 will be described in detail later.

In addition, the upper heater 21 which is arranged to be vertically further separated in a direction opposite to the platen 8 than the head 1 (region where the head 1 moves along the carriage shaft 3) is arranged inside the apparatus body 2. The upper heater 21 has a function which is the same as that of the platen heater 20. That is, in response to the execution of the printing process, the upper heater 21 heats the platen 8, heats the recording sheet S via the heated platen 8, and quickens the drying of the ink landed on the surface of the recording sheet S. Then, the platen 8 heated by the upper heater 21 according to the embodiment or the recording sheet S supported by the platen 8 further heats the head 1. That is, the upper heater 21 is also used in indirectly heating the head 1.

The platen heater 20 and the upper heater 21 have a nichrome wire (not illustrated) as an example. Then, energizing generates the heat of the nichrome wire itself. For example, the heat is transferred to the platen 8 formed of a resin material, thereby enabling the heat to be transferred to the recording sheet S on the upper surface of the platen 8. The platen heater 20 and the upper heater 21 are controlled by a controller 100 (to be described later).

In addition, the ink jet recording apparatus I has the controller 100 (to be described in detail later) which serves as a control unit for controlling an operation of the ink jet recording apparatus I. In this ink jet recording apparatus I, the controller 100 causes the carriage 4 to move along the carriage shaft 3 and causes the head 1 to eject the ink for printing on the recording sheet S.

Furthermore, in the ink jet recording apparatus I, the controller 100 causes the head 1 to move to a temperature setting position and uses the above-described heating unit to perform temperature setting on the head 1.

The temperature setting position is referred to as a position where the heat radiated from the heating unit is transferred to the head 1. The heating unit of the embodiment is configured to have the platen 8, the platen heater 20 and the upper heater 21. In this case, a position to where the heat radiated from the platen 8 heated by the platen heater 20 and the upper heater 21 is transferred, and a position to where the heat radiated from the upper heater 21 is transferred are referred to as the temperature setting positions.

More specifically, a position vertically opposing the platen 8 is the temperature setting position. In the embodiment, the head 1 is mounted on the carriage 4 moving along the carriage shaft 3 and moves in the main scanning direction. Within a range where the head 1 is movable in this main scanning direction, a range opposing the platen 8 is a temperature setting position R (refer to FIG. 3B).

Furthermore, in the embodiment, the upper heater 21 is arranged above (vertically opposite side to the recording sheet S) the head 1 (region where the head 1 moves along the carriage shaft 3). Accordingly, a position of the upper heater 21 which vertically opposes the recording sheet S side is the temperature setting position R. That is, in the embodiment, the temperature setting position R is the position opposing the platen 8, and is also the position opposing the upper heater 21.

Within a range where the head 1 is movable along the carriage shaft 3, regions other than the temperature setting position R, that is, regions which do not oppose the platen 8 or the upper heater 21 are referred to as a non-opposing region O1 and a non-opposing region O2. The non-opposing region O1 is a home position side of the carriage 4 (to be described later) than the temperature setting position R, and the non-opposing region O2 is a region which is further separated from the home position than the temperature setting position R.

The heat radiated from the platen 8 (heat transferred from the platen heater 20 or the upper heater 21) and the heat radiated from the upper heater 21 are transferred to the head 1 located at the above-described temperature setting position R. Not only the heat radiated from the platen 8, but also the heat radiated from the recording sheet S heated by the platen 8 are transferred to the head 1 located at the temperature setting position R.

The head 1 is moved to the temperature setting position R along the carriage shaft 3 by the controller 100, and is heated by the heat radiated from the platen heater 20 and the upper heater 21. A heating process by moving the head 1 to the temperature setting position R will be described later.

In addition, the ink jet recording apparatus I has a cap member 22 and a capping device 23 including the same. The cap member 22 and the capping device 23 are arranged at a position corresponding to the home position of the carriage 4, that is, in the vicinity of one end portion of the carriage shaft 3.

The cap member 22 prevents the ink from being dried by sealing a nozzle surface. In addition, this cap member 22 also functions as an ink receiver during a flushing operation. Furthermore, an absorption device (not illustrated) configured to have a tube pump or the like as an example of an absorption unit is connected to the cap member 22. At a predetermined time, the ink jet recording apparatus I causes the absorption device to perform an absorption operation for internally absorbing the cap member 22. This prevents clogging of nozzle openings of the head 1 or occurrence of ejection failures such as missing dots. The flushing operation and the absorption operation will be described later.

Figure 4A:
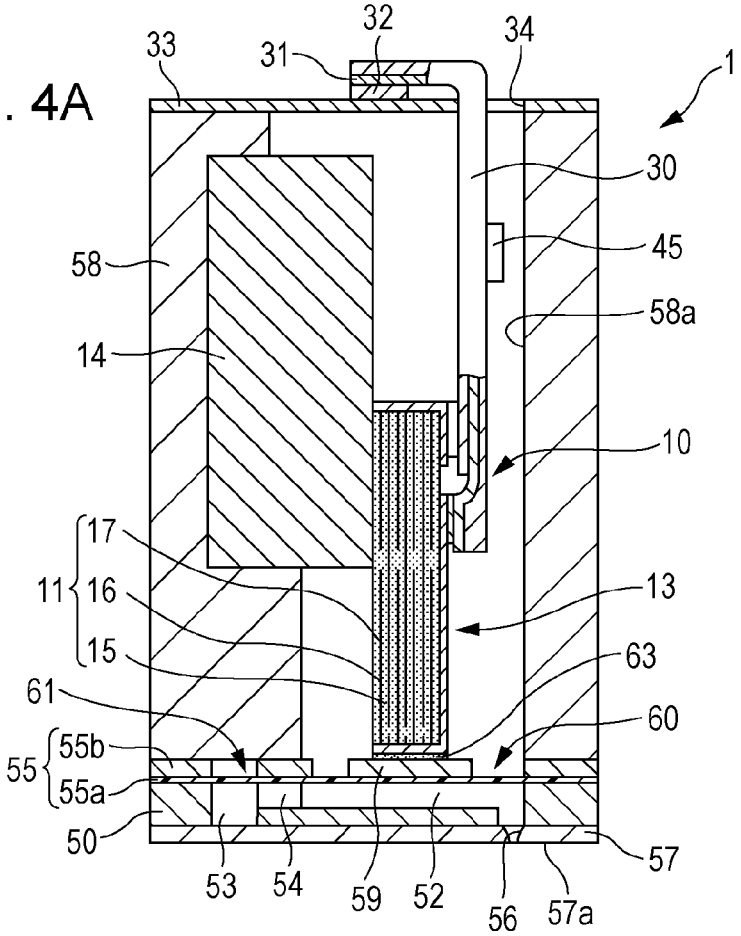
FIGS. 4A and 4B are cross-sectional views of a head.
Figure 4B:
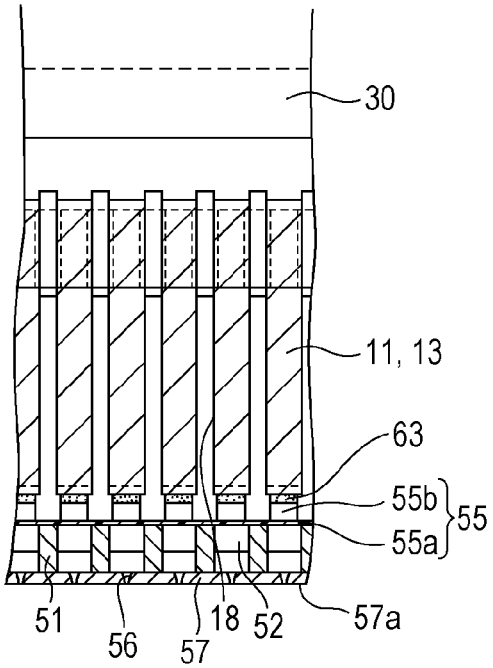

The head 1 will be described with reference to FIGS. 4A and 4B. FIGS. 4A and 4B are cross-sectional views illustrating the head 1 according to the first embodiment of the invention.

The head 1 includes multiple actuator units 10, a case 58 which can internally accommodate the actuator units 10, a flow path substrate 50 bonded to one side surface of the case 58, and a nozzle plate 57.

The actuator unit 10 of the embodiment has a piezoelectric actuator forming member 13 and a stationary plate 14. The piezoelectric actuator forming member 13 is formed so that multiple piezoelectric actuators 11 are juxtaposed in a width direction. In the piezoelectric actuator forming member 13, a base end portion thereof (one end portion) is bonded to the stationary plate 14 as a fixed end, and a tip portion (the other end) is a free end.

The piezoelectric actuator forming member 13 is formed by alternately stacking a piezoelectric material 15, an individual electrode 16 and a common electrode 17 on one another. The individual electrode 16 and the common electrode 17 are internal electrodes configuring two poles of the piezoelectric actuator 11. The individual electrode 16 configures an individual electrode which is electrically independent from the adjacent piezoelectric actuator 11. The common electrode 17 configures a common electrode which is electrically independent from the adjacent piezoelectric actuator 11.

For example, multiple slits 18 are formed in the piezoelectric actuator forming member 13 by a wire saw. The tip portion side of the piezoelectric actuator forming member 13 is cut into comb tooth shapes by the multiple slits 18 so as to form a row of the piezoelectric actuators 11.

A region bonded to the stationary plate 14 of the piezoelectric actuator 11 is a non-active region which does not contribute to vibrations. If a voltage is applied to a portion between the individual electrode 16 and the common electrode 17 which configure the piezoelectric actuator 11, only a region of the tip portion side which is not bonded to the stationary plate 14 is vibrated.

For example, a circuit board 30 such as a COF is connected to each piezoelectric actuator 11 of the actuator unit 10. A drive circuit (not illustrated) such as a drive IC for driving the piezoelectric actuator 11 is mounted on the circuit board 30.

The flow path substrate 50 is configured to have a silicon single crystal substrate, and multiple pressure generation chambers 52 are juxtaposed in the width direction. Specifically, the respective pressure generation chambers 52 are divided by multiple partition walls 51 formed on one side surface layer portion of the flow path substrate 50.

A manifold 53 communicates with the respective pressure generation chambers 52 via an ink supply path 54. In addition, a vibration plate 55 is bonded to one side surface of the flow path substrate 50, and the nozzle plate 57 is bonded to the other side surface. The vibration plate 55 seals an opening surface of the pressure generation chamber 52. The nozzle plate 57 is punched to form nozzle openings 56, and is bonded to the flow path substrate 50 via an adhesive or a thermal welding film. The pressure generation chamber 52 of the flow path substrate 50 communicates with the nozzle openings 56 of the nozzle plate 57.

For example, the vibration plate 55 is configured to include an elastic film 55*a* formed of an elastic member such as a resin film and a support plate 55*b* which supports the elastic film 55*a*. The vibration plate 55 is configured so that the elastic film 55*a* side is bonded to the flow path substrate 50.

In addition, an island portion 59 is disposed inside a region opposing the respective pressure generation chambers 52 of the vibration plate 55. The island portion 59 is a region with which a tip portion of the piezoelectric actuator 11 comes into contact. Specifically, the vibration plate 55 has a slim portion 60 and the island portion 59. The slim portion 60 is a region opposing a peripheral portion of the respective pressure generation chambers 52, within the vibration plate 55, and a thickness thereof is thinner than those of the other regions. The slim portion 60 is configured to have only the elastic film 55*a* substantially. In addition, the island portion 59 is disposed inside the slim portion 60, and the tip portion of the piezoelectric actuator 11 is fixed onto an upper surface of the island portion 59 by means of an adhesive 63.

Furthermore, a region opposing the manifold 53 within the vibration plate 55 is a compliance portion 61. Similar to the slim portion 60, the compliance portion 61 is configured to have only the elastic film 55*a* substantially. The slim portion 60 and the compliance portion 61 are formed by performing etching removal on the support substrate 55*b*.

When a pressure change occurs inside the manifold 53, the compliance portion 61 absorbs the pressure change by the compliance portion 61 (elastic film 55*a*) itself being deformed, and carries out a role for holding a constant pressure inside the manifold 53 at all times.

In the embodiment, the elastic film 55*a* and the support substrate 55*b* configure the vibration plate 55, and the slim portion 60 and the compliance portion 61 are configured to have only the elastic film 55*a*, but the configurations are not particularly limited thereto. For example, the concave slim portion 60 and compliance portion 61 and the island portion 59 which are relatively thicker than the portions may be formed by using one sheet of plate-shaped member as the vibration plate and removing a portion of the plate-shaped member in the thickness direction.

The case 58 is fixed onto the vibration plate 55 of the flow path substrate 50. An ink introduction path (not illustrated) is disposed in the case 58. The ink is supplied from an ink cartridge 5 (refer to FIG. 1) to the ink introduction path.

In addition, multiple accommodation units 58*a* penetrating in the thickness direction are disposed in the case 58, and the actuator unit 10 is fixed to the respective accommodation units 58*a*.

A wiring board 33 is fixed onto the case 58. The accommodation unit 58*a* of the case 58 is substantially closed by the wiring board 33. In the wiring board 33, a slit-shaped opening 34 is formed in a region opposing the accommodation unit 58*a* of the case 58. The circuit board 30 is drawn out by being bent from the opening 34 of the wiring board 33 to an outside of the accommodation unit 58*a*.

Multiple conductive pads 32 to which wires 31 of the circuit board 30 are respectively connected are disposed in the wiring board 33. The respective wires 31 of the circuit board 30 are electrically connected to the individual electrode 16 and the common electrode 17 which configure the piezoelectric actuator 11, in the base end portion side thereof. In contrast, the respective wires 31 are bonded to the respective conductive pads 32 of the wiring board 33, in the tip portion side.

In addition, a temperature sensor 45 is disposed in the circuit board 30. The temperature sensor 45 measures an environmental temperature (ambient temperature) outside the head 1. A temperature measured by the temperature sensor 45 is transmitted to the controller 100 (to be described later), and a drive waveform of the head 1 is corrected based on the temperature.

When ink droplets are ejected, the above-described head 1 ejects the ink droplets from predetermined nozzle openings 56 in such a manner that deformation of the piezoelectric actuator 11 and the vibration plate 55 changes a volume of the respective pressure change chambers 52.

More specifically, if the ink is supplied from the ink cartridge 5 (refer to FIG. 1) to the manifold 53, the ink is distributed to the respective pressure generation chambers 52 via the ink supply path 54. Practically, the piezoelectric actuator 11 is contracted by applying a voltage to the piezoelectric actuator 11. This causes the vibration plate 55 to be deformed together with the piezoelectric actuator 11, the volume of the pressure generation chamber 52 is expanded, and the ink is drawn into the pressure generation chamber 52. Then, after the ink internally fills the pressure generation chamber 52 until the ink reaches the nozzle openings 56, in response to a recording signal supplied via the circuit board 30, the voltage applied to the individual electrode 16 and the common electrode 17 of the piezoelectric actuator 11 is released. This causes the piezoelectric actuator 11 to be extended to restore the original state, and also causes the vibration plate 55 to be displaced to restore the original state. As a result, the volume of the pressure generation chamber 52 is contracted, the pressure inside the pressure generation chamber 52 is increased, and the ink droplets are ejected from the nozzle openings 56.

Figure 5:
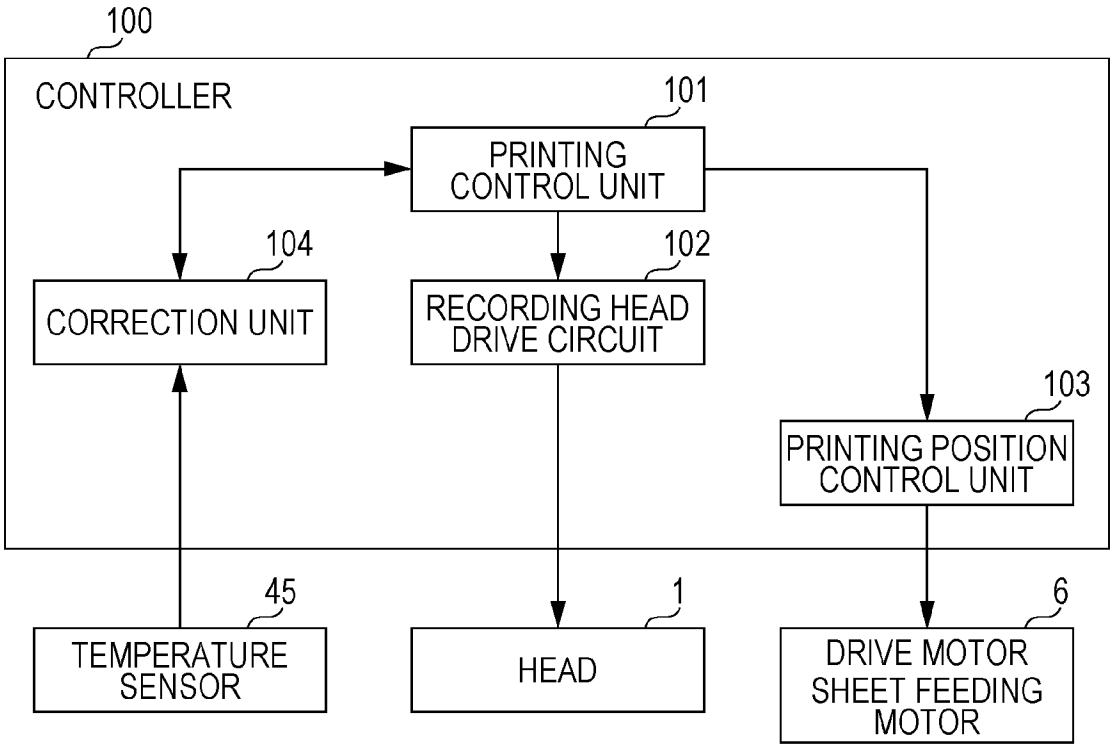
FIG. 5 is a functional block diagram of a controller.

The controller 100 which controls the ink jet recording apparatus I will be described. FIG. 5 is a functional block diagram of the controller 100 according to the embodiment. The controller 100 includes a printing control unit 101, a recording head drive circuit 102, a printing position control unit 103 and a correction unit 104.

The printing control unit 101 controls a printing operation of the head 1. For example, in response to an input of a recording signal, a drive pulse is applied to the piezoelectric actuator 11 via the recording head drive circuit 102, and the ink is ejected from the head 1.

The printing position control unit 103 performs positioning in the main scanning direction and the sub-scanning direction during the printing, non-printing and absorption operation of the head 1. More specifically, the printing position control unit 103 drives the drive motor 6 and moves the carriage 4 in the main scanning direction, thereby performing the positioning of the head 1 in the main scanning direction. In addition, the printing position control unit 103 drives a sheet feeding motor (not illustrated) to drive the platen 8, and moves the recording sheet S in the sub-scanning direction, thereby performing the positioning of the head 1 in the sub-scanning direction with respect to the recording sheet S.

During the printing, the printing position control unit 103 moves the carriage 4 on which the head 1 is mounted, in the main scanning direction, and moves the recording sheet S in the sub-scanning direction. In addition, during the non-printing such as during printing standby and during a cleaning operation, the printing position control unit 103 moves the carriage 4 on which the head 1 is mounted, to the home position (non-printing region).

Based on temperature information detected by the temperature sensor 45, the correction unit 104 controls the printing control unit 101 so as to change various setting conditions such as the drive waveform. Here, the viscosity of the ink is correlated with the temperature. Thus, there are characteristics that the viscosity increases as the temperature decreases and the viscosity decreases as the temperature increases. Therefore, it is necessary to correct the drive signal (drive waveform) for driving the piezoelectric actuator 11 in accordance with the viscosity changed by the temperature of the ink.

In the embodiment, the temperature sensor 45 disposed in the circuit board 30 inside the accommodation unit 58*a* detects the ambient temperature inside the accommodation unit 58*a*. The temperature sensor 45 cannot directly detect the temperature of the ink inside the flow path, but estimates an actual temperature of the ink inside the flow path such as the manifold 53 based on the temperature of the ink.

Based on the temperature information detected by the temperature sensor 45, the correction unit 104 estimates the actual temperature of the ink flowing in the flow path, and controls the printing control unit 101 so as to generate the drive signal suitable for the actual temperature of the ink.

Practically, the correction unit 104 holds a correction table in which the temperature information detected by the temperature sensor 45 is associated with a correction value for correcting a waveform shape of the voltage or time of the drive signal indicated by the drive waveform. Based on the temperature information detected by the temperature sensor 45, the correction unit 104 directly corrects the drive signal without estimating the actual temperature of the ink.

Figure 6:
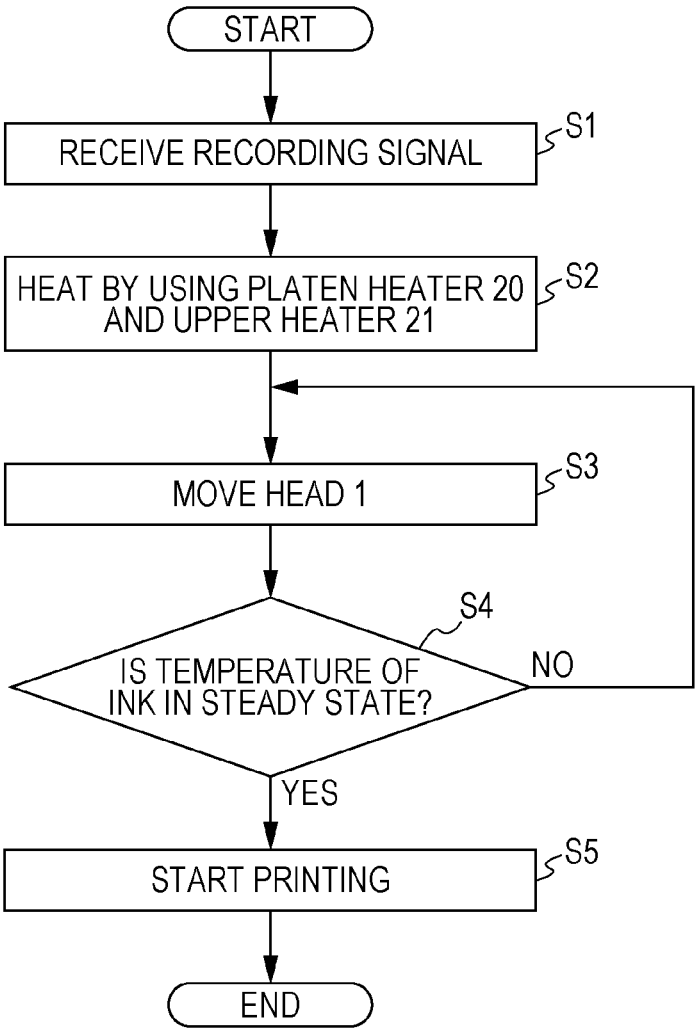
FIG. 6 is a flowchart illustrating an operation of a recording apparatus according to the first embodiment.

Before the ink is ejected by the head 1, the controller 100 having the above-described configuration heats the head 1 by using the heat radiated from the heating unit configured to have the platen 8, the platen heater 20 and the upper heater 21. Referring to FIG. 6, a control for heating the head 1 prior to the ink ejection will be described. FIG. 6 is a flowchart illustrating an operation of the ink jet recording apparatus according to the embodiment.

The controller 100 receives a recording signal (step S1). The recording signal is information provided from a device such as a personal computer (not illustrated) to the controller 100 via an interface. The recording signal is configured to include data, character codes, graphic functions and image data which indicate characters or images to be ejected onto the recording sheet S.

If the controller 100 receives the recording signal, the controller 100 performs an operation for heating the head 1 before ejecting the ink (printing) in accordance with the recording signal. Therefore, the controller 100 first operates the platen heater 20 and the upper heater 21, and sets the temperature to be a predetermined temperature (step S2). For the ink, a temperature suitable for ejection is set. The controller 100 sets the platen heater 20 and the upper heater 21 to have the predetermined temperature which is the same as the temperature suitable for the ejection. In this manner, the platen 8 is heated by the platen heater 20 and the upper heater 21, and is set to have the predetermined temperature. The description in the embodiment, "to set", is used as "to be heated up to the predetermined temperature", and is not used as "to reach the predetermined temperature".

Next, the controller 100 moves the head 1 to the temperature setting position R opposing the platen 8 (step S3). In the head 1 which is moved to this temperature setting position R (refer to FIG. 3B), the temperature of the head 1 is caused to rise by the heat radiated from the platen 8 heated by the platen heater 20 and the upper heater 21, and the recording sheet S heated by the platen 8. A heating target is the entire head 1, specifically, the nozzle plate 57, the case 58, the flow path of the ink (pressure generation chamber 52, manifold 53, ink supply path 54 and the like) and further the carriage 4. The heating unit causes the temperature of the head 1 to become close to the predetermined temperature set due to the heating unit.

A heating process after moving the head 1 to the temperature setting position R will be described in detail later.

Next, the controller 100 determines whether the temperature of the ink inside the head 1, particularly the temperature of the ink in the vicinity of the nozzle openings 56, is in a steady state (step S4). The description herein, "whether or not the temperature of the ink is in a steady state", is determined by the description, "whether or not an amount of change in the temperature of the ink per unit time is a predetermined value or less". The predetermined value is set in advance in the controller 100. If it is detected that the amount of change in the temperature of the ink per unit time which is obtained by the temperature sensor 45 is the predetermined value or less, the controller 100 determines that the temperature of the ink is in the steady state.

In addition, "whether or not the temperature of the ink is in a steady state" may be determined by whether or not heating time period of the head 1 reaches a predetermined time period. The description herein, "the heating period time of the head 1", means "a time period when the head 1 is placed at the temperature setting position R".

The predetermined time period means a time period required so that deviation between a temperature measurement value obtained by the temperature sensor 45 of the head 1 and the actual temperature of the ink is sufficiently small. The predetermined time period is set depending on the setting temperature of the heating unit, the temperature setting position R opposing the heating unit, and movement conditions of the head 1.

The predetermined time period is recorded in the controller 100 in advance, and the controller 100 refers to the predetermined time period. Then, the controller 100 separately measures the heating time period of the head 1, and determines whether the heating time period reaches the predetermined time period.

In addition, instead of the determination as to whether or not the amount of change in the temperature of the ink is the predetermined value or less, it may be determined that the temperature of the ink is in the steady state by determining whether or not the temperature of the platen heater 20 or the upper heater 21 reaches a predetermined temperature. In this case, for example, the temperature of the platen heater 20 or the upper heater 21 may be a temperature measurement value obtained by a temperature sensor disposed in the platen 8. Furthermore, when the temperature measurement value obtained by the temperature sensor is approximately close to the predetermined temperature set by the controller 100, it may be determined that the temperature of the ink is in the steady state. For example, when the predetermined temperature is 50° C., within a range of plus or minus 10%, the temperature of 45° C. to 55° C. is approximately close to the predetermined temperature.

Unless the temperature of the ink is in the steady state (step S4: No), the heating of the head 1 is continued at the temperature setting position R.

If the temperature of the ink is in the steady state (step S4: Yes), the heating of the head 1 is stopped. For example, the temperature of the platen heater 20 or the upper heater 21 is caused to return to room temperature, or the head 1 is moved to be separated from the temperature setting position R.

In this manner, the entire head 1 is heated by moving the head 1 to the temperature setting position R. That is, all including the head 1 provided with the temperature sensor 45, the ambient temperature and the ink inside the ink flow path are heated. Then, if the heating time period reaches the predetermined time period, the temperature measured by the temperature sensor 45 is in the steady state, the deviation with the actual temperature of the ink is sufficiently small, and there is no more variation. Therefore, the temperature of the ink based on the temperature measurement value obtained by the temperature sensor 45 of the head 1 represents a result of accurately estimating the actual temperature of the ink.

In addition, the head 1 is heated by being moved to the temperature setting position R. That is, the head 1 is heated in a state of being moved to a position close to a heat source. Therefore, it is possible to shorten the time period required until the temperature of the ink inside the head 1 reaches the predetermined temperature to be in the steady state.

Next, based on the temperature of the ink estimated by the temperature sensor 45, the controller 100 corrects the drive waveform. Then, the controller 100 moves the head 1 while heating the recording sheet S by using the platen 8 heated by the platen heater 20 and the upper heater 21. Based on the corrected drive waveform, the controller 100 causes the head 1 to eject the ink to perform the printing (step S5).

Herein, a heating process by moving the head 1 to the temperature setting position R will be described in detail.

First, the controller 100 starts heating of the platen 8 by using the platen heater 20 and the upper heater 21 (step S2), and then heats the head 1 at the temperature setting position R without causing the head 1 to eject the ink (step S3). A period when a control is performed until printing start (step S5) after the head 1 is set to have the predetermined temperature is referred to as "during the heating".

In addition, a period when the controller 100 performs a control for ejecting the ink based on the recording signal while moving the head 1 in the main scanning direction (step S5) is referred to as "during the printing".

The description, "printing start", means that the head 1 starts to be moved by one pass when the ink is landed on the recording sheet S for the first time. One pass means a printing operation in which the ink is ejected while moving the head 1 from one side to the other side in the main scanning direction. In so-called bi-directional printing, an operation in which the ink is ejected while moving the head 1 from one side to the other side in the main scanning direction is one pass, and an operation in which the ink is ejected while returning the head 1 from the other side to one side is another pass.

Figure 7:
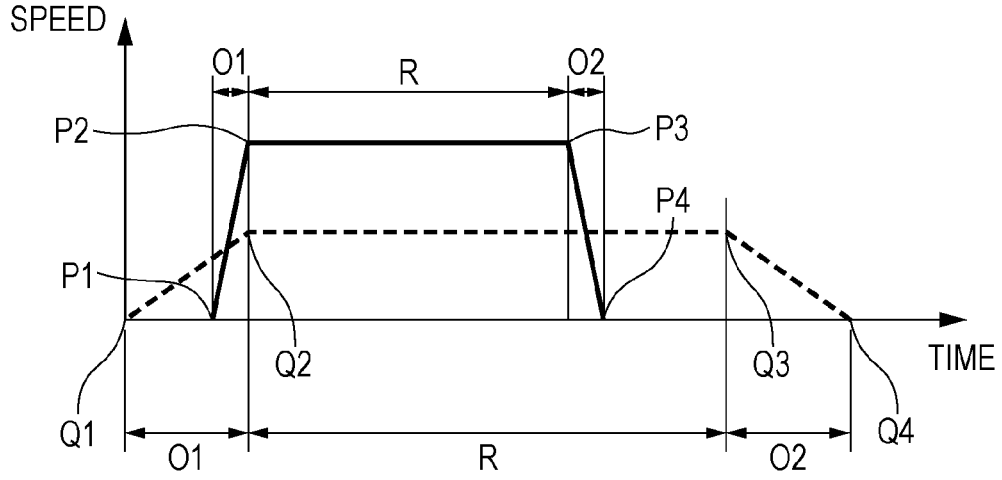
FIG. 7 is a graph illustrating a speed of a head and a time period required for a movement of the head.

Referring to FIG. 7, a heating process of the head 1 will be described. FIG. 7 is a graph illustrating a speed and a movement of the head 1. A horizontal axis represents time and a vertical axis represents the speed of the head 1 (carriage 4) moving along the carriage shaft 3. A solid line represents a temporal change in the speed of the head 1 during the printing, and a dotted line represents a temporal change in the speed of the head 1 during the heating. As described below, the controller 100 controls the operation of the head 1.

During one pass where the printing is performed while the head 1 is sequentially moved through the non-opposing region O1, the temperature setting position R and the non-opposing region O2 in this order, it is assumed that the head 1 is moved at the following speed. That is, in the printing during one pass, as illustrated by a slope of P1 to P2, the head 1 accelerates in speed when staying in the non-opposing region O1, and approaches the temperature setting position R. Then, as illustrated by a slope of P2 to P3, the head 1 is moved toward the non-opposing region O2 at a constant speed when staying at the temperature setting position R. Finally, as illustrated by a slope of P3 to P4, the head 1 decelerates in speed to stop when reaching the non-opposing region O2.

In contrast, when the head 1 is heated after the head 1 is moved in a range which is the same as that of one pass, the following speed can be applied thereto. That is, when heating the range which is the same as that of one pass, as illustrated by a slope of Q1 to Q2, the head 1 accelerates in speed when staying in the non-opposing region O1, and approaches the temperature setting position R. However, the speed is slower than the speed during the printing. Then, as illustrated by a slope Q2 to Q3, the head 1 is moved toward the non-opposing region O2 at a constant speed when staying at the temperature setting position R. In this case, the speed is also slower than the speed during the printing. Finally, as illustrated by a slope of Q3 to Q4, the head 1 decelerates in speed to stop when reaching the non-opposing region O2.

In this manner, a time period (Q2 to Q3) when the head 1 stays at the temperature setting position R while performing the temperature setting by moving the head 1 in the range the same as one pass is longer than a time period (P2 to P3) when the head 1 stays at the temperature setting position R within a time period (P1 to P4) required for one pass printing of the head 1.

Therefore, during the printing, the head 1 can eject the ink while being moved in a shorter time than the time during the heating. Accordingly, it is possible to improve a printable amount per unit time. In other words, since only the time period when the head 1 stays at the temperature setting position R during the heating is shortened, there is no possibility that the speed during the printing may be decelerated.

In addition, during the heating, the head 1 can stay at the temperature setting position R for a longer time than the time during the printing. Accordingly, it is possible to improve a heating effect of the head 1.

Furthermore, the maximum speed of the head 1 during the heating is slower than the maximum speed of the head 1 during the printing. Therefore, during the printing, the head 1 can eject the ink while being moved faster than the time during the heating. Accordingly, it is possible to improve the printable amount (printable area) per unit time. In other words, since only the moving speed of the head 1 during the heating is decelerated, there is no possibility that the speed during the printing may be decelerated.

In addition, during the heating, the head 1 is moved through the temperature setting position R slower than the time during the printing. Accordingly, it is possible to improve the heating effect of the head 1.

Figure 8:
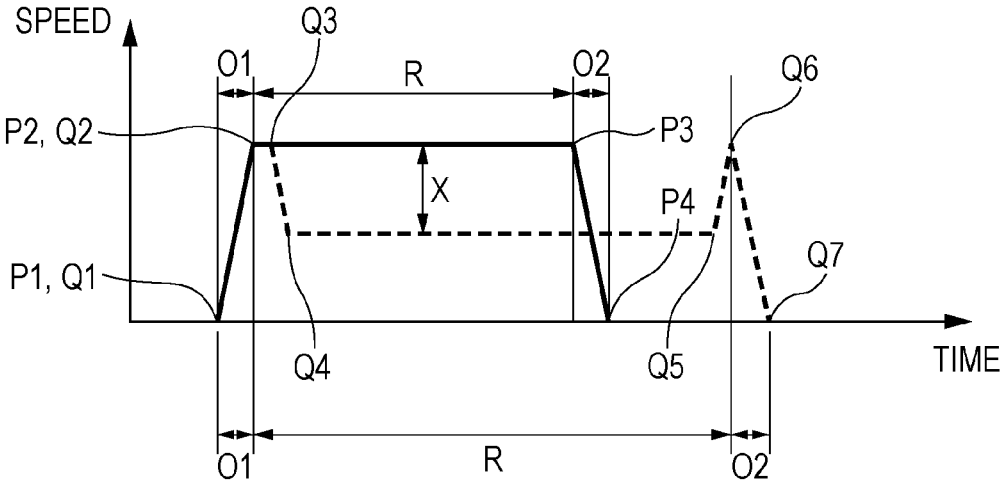
FIG. 8 is a graph illustrating a speed of a head and a time period required for a movement of the head.

Referring to FIG. 8, another heating process of the head 1 will be described. FIG. 8 is a graph illustrating a speed of the head 1 and a time period required for a movement. The horizontal axis represents the time period, and the vertical axis represents the speed of the head 1 (carriage 4) moving along the carriage shaft 3. The solid line represents a temporal change in the speed of the head 1 during the printing, and the dotted line represents a temporal change in the speed of the head 1 during the heating. As described below, the controller 100 controls the operation of the head 1.

The head 1 has the same process as that of FIG. 7, and thus the description will not be repeated.

In contrast, when the head 1 is heated after the head 1 is moved in a range which is the same as that of one pass, the following speed can be applied thereto. That is, when heating the range which is the same as that of one pass, as illustrated by the slope of Q1 to Q2, the head 1 accelerates in speed when staying in the non-opposing region O1, and approaches the temperature setting position R. In this case, the speed is the same as the speed during the printing. Thereafter, as illustrated by a slope Q2 to Q3 where the head 1 initially enters the temperature setting position R, the head 1 is moved at a constant speed. Next, the head 1 decelerates in speed as illustrated by the slope of Q3 to Q4, and then is moved up to Q5 in front of the non-opposing region O2 at a constant speed. The speed of Q4 to Q5 is slower than the speed during the printing. Then, as illustrated by the slope of Q5 to Q6, the head 1 accelerates in speed in front of the non-opposing region O2, and as illustrated by the slope of Q6 to Q7, the head 1 decelerates in speed to stop in the non-opposing region O2. The deceleration in the non-opposing region O2 is the same as the deceleration during the printing (P3 to P4).

A difference between the speed of the head 1 moving through the temperature setting position R (speed in P2 to P3) during the printing and the speed of the head 1 moving through the temperature setting position R (speed in Q2 to Q6) during the heating is set to be a first speed difference. When these speeds are changing, an average speed at the temperature setting position R is obtained for the former speed, and an average temperature at the temperature setting position R is obtained for the latter speed, thereby setting the difference therebetween to be the first speed difference.

In contrast, a difference between the speed of the head 1 moving through the non-opposing regions O1 and O2 (speed in P1 to P2 and P3 to P4) during the printing and the speed of the head 1 moving through the non-opposing regions O1 and O2 (speed in Q1 to Q2 and Q6 to Q7) during the heating is set to be a second speed difference. In the embodiment, the speeds in the non-opposing region O1 are the same as each other (slopes match each other) not only during the printing, but also during the heating. In addition, the speeds in the non-opposing area O2 are the same as each other (slopes match each other) not only during the printing, but also during the heating. Accordingly, the second speed difference is zero. The second speed difference may not necessarily be zero.

The above-described first speed difference is greater than the second speed difference. The description, "the first speed difference is greater than the second speed difference", means that at the temperature setting position R, during the printing, the head 1 ejects the ink while being moved faster than the time during the heating. Therefore, it is possible to improve the printable amount per unit time. In other words, since only the moving speed of the head 1 at the temperature setting position R during the heating is decelerated, there is no possibility that the speed during the printing may be decelerated. In order to decelerate the moving speed of the head 1 at the temperature setting position R during the heating, a difference in the minimum speed may be set to be the first speed difference instead of a difference in the average speed (refer to a reference numeral X). Even in this case, in a ratio of the time period when the head 1 stays at the temperature setting position R to the time period required for one pass, the time period during the heating can be lengthened more than the time period during the printing. Therefore, it is possible to improve the heating effect.

In addition, by causing the first speed difference to be greater than the second speed difference, it is possible to move the head 1 in the non-opposing regions O1 and O2, at the speed equal to that during the printing, even during the heating. Since the non-opposing regions O1 and O2 do not contribute to the heating of the head 1, it is possible to cause the head 1 to quickly pass therethrough. In this manner, it is possible to quickly move the head 1 to the temperature setting position R to perform the heating. Therefore, it is possible to shorten the time period required from the time during the heating to the printing start.

Although not particularly illustrated, the process of moving and heating the head 1 is not limited to the above-described processes. For example, in the processes illustrated in FIGS. 7 and 8, one pass has been described. However, multiple passes may be performed by repeatedly causing the head 1 (carriage 4) to reciprocate the temperature setting position R in the main scanning direction. In addition, during the heating, the head 1 may be stopped at the temperature setting position R.

In addition, the number per unit time of departures of the head 1 from the temperature setting position R during the printing may be configured to be less than the number per unit time of departures of the head 1 from the temperature setting position R during the printing. The description, "the number per unit time of departures of the head 1 from the temperature setting position R", means the number of movements of the head 1 from the temperature setting position R to the non-opposing region O1 or the non-opposing region O2. In addition, the unit time described herein may be either a time period required during the heating or a predetermined time period.

For example, when the head 1 is caused to perform 10 passes during the printing, the head 1 is deviated from the temperature setting position R once per one pass. Accordingly, the number per unit time of departures of the head 1 from the temperature setting position R is ten times. In contrast, the head 1 is moved to the temperature setting position R during the heating, a state where the head 1 stays at the temperature setting position R is maintained (the head 1 may be stopped, or may be moved into the temperature setting position R), and the head 1 is caused to return to the home position by completing the heating. In this case, the number of the departures of the head 1 from the temperature setting position R during the heating is one time.

That is, the reason why the number per unit time of the departures of the head 1 from the temperature setting position R is set as described above is to reduce the number of travels where the head 1 is deviated from the temperature setting position R to return to the home position during the heating. Therefore, during the heating, it is possible to place the head 1 at the temperature setting position R serving as a position for heating for a long time. Accordingly, it is possible to cause the temperature of the head 1 to quickly reach the predetermined temperature.

As a matter of course, after the head 1 is moved to the temperature setting position R, the head 1 is moved to the non-opposing regions O1 and O2 (for example, the head 1 is caused to return to the home position), and the head 1 is moved to the temperature setting position R again. In this manner, the head 1 may be intermittently moved to the temperature setting position R for the heating.

In addition, although not particularly illustrated, a paper gap G (refer to FIG. 2) between the nozzle surface 57*a* of the head 1 (Refer to FIG. 2) and the recording sheet S may be differently arranged during the heating and during the printing. More specifically, the paper gap G during the heating may be arranged to be smaller than the paper gap G during the printing. The paper gap G during the printing means the paper gap G when the head 1 is moved along the carriage shaft 3. In addition, the paper gap G during the heating means the minimum value of the paper gap G when the head 1 stays the temperature setting position R.

Here, in some cases, the recording sheet S absorbs the landed ink, and is warped (so-called cockling). In addition, in some cases, the recording sheet S is warmed by the heat, thereby being warped. If the recording sheet S is warped in this way, there is a possibility that the recording sheet S may come into contact with the nozzle surface 57*a* of the head 1.

However, even if the paper gap G during the heating is arranged to be smaller than the paper gap G during the printing, the paper gap G during the printing is greater than the paper gap G during the heating. Accordingly, even if the recording sheet S is warped, it is possible to prevent the recording sheet S from coming into contact with the nozzle surface 57*a* of the head 1. In contrast, the paper gap G during the heating is smaller than the paper gap G during the printing. That is, the head 1 is close to the platen 8. Therefore, it is possible to heat the head 1 by more efficiently transferring the heat radiated from the platen 8 to the head 1.

As described above, before the ink is ejected from the head 1, the ink jet recording apparatus I according to the embodiment moves the head 1 to the temperature setting position R and causes the heating unit to heat the head 1. That is, prior to the printing, the head 1 is moved close to the heating unit to be heated. In this manner, it is possible to shorten the time period required until the temperature of the ink inside the head 1 reaches the predetermined temperature to restore the steady state. Then, the temperature measured by the temperature sensor 45 is in the steady state, the deviation with the actual temperature of the ink is sufficiently small, and there is no more variation. Therefore, the temperature of the ink based on the temperature measurement value obtained by the temperature sensor 45 of the head 1 represents a result of accurately estimating the actual temperature of the ink. In this manner, since the actual temperature of the ink can be accurately obtained, if the drive signal is corrected based on the temperature, it is possible to correct the drive signal so as to be most suitable for the viscosity of the actual ink. This enables ejection properties of the ink to be improved, thereby improving ejection quality. In particular, even in the initial stage of ejecting the ink, such as when power is supplied to the ink jet recording apparatus I, it is possible to perform high quality printing.

In particular, as the heating unit that heats the head 1, the embodiment employs the platen heater 20 and the upper heater 21 which are used in heating the recording sheet S. If the printing is performed by using the platen heater 20 and the upper heater 21 after the ink is ejected onto the recording sheet S, the time period for drying the ink can be generally shortened. Accordingly, it is possible to suppress smearing of the ink. That is, the heating unit for heating the head 1 also serves as the heating unit for heating the recording sheet S. Therefore, it is possible to heat the head 1 without newly disposing the heating unit. In this manner, it is possible to provide the ink jet recording apparatus I with reduced costs.

The ink jet recording apparatus I according to the embodiment employs the heating unit as the temperature setting unit, but the embodiment is not limited to the heating. The temperature setting unit may have a configuration in which the temperature of the head 1 is set to be lower than room temperature as long as the temperature suitable for the ejection of the ink is lower than room temperature.

Second Embodiment

In the first embodiment, the temperature setting position R is the position opposing the platen 8 and the upper heater 21, but the embodiment is not limited thereto. In the embodiment, another embodiment of the temperature setting position R will be described.

Figure 9A:
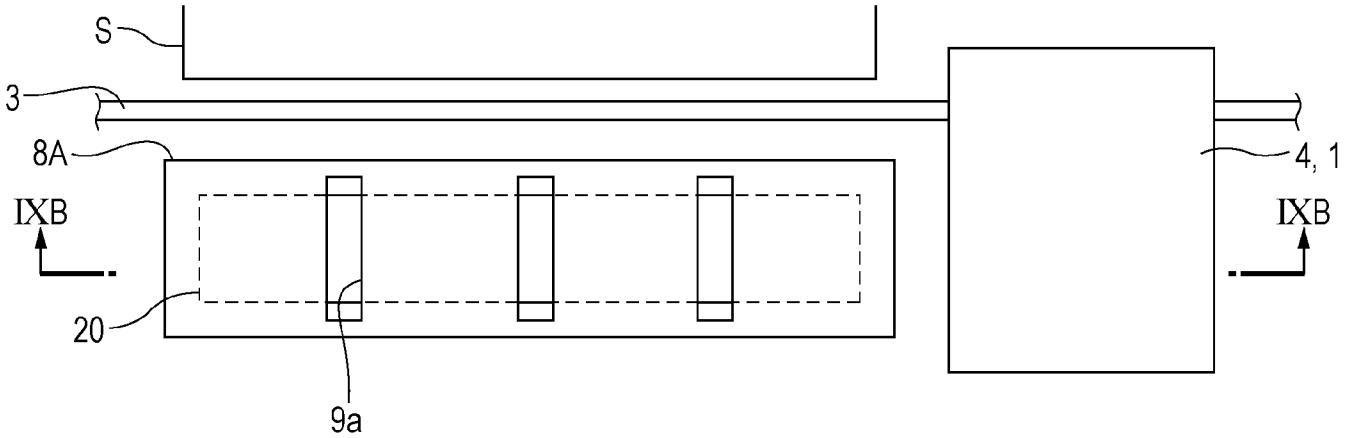
FIGS. 9A and 9B are a top view and a cross-sectional view which illustrate a configuration of a heating unit according to a second embodiment.
Figure 9B:
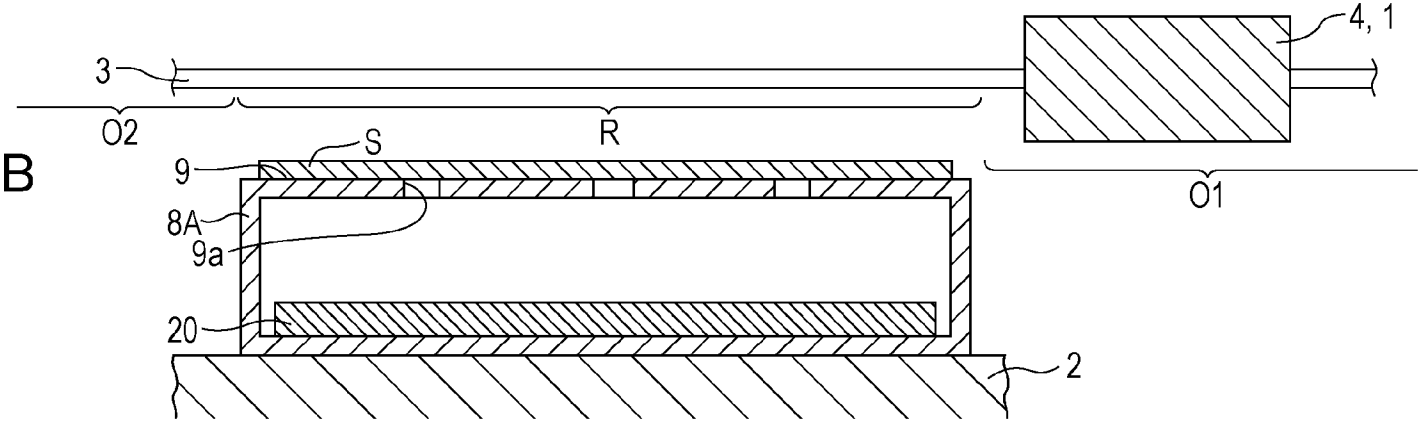

FIG. 9A is a top view illustrating a configuration of a heating unit, and FIG. 9B is a cross-sectional view taken along line VIIIIB-VIIIIB in FIG. 9A. The same reference numerals are given to the same elements as those of the first embodiment, and the description thereof will not be repeated.

As illustrated in FIGS. 9A and 9B, the heating unit according to the embodiment includes a platen 8A as an example of the support member, and a platen heater 20 which heats the platen 8A form the opposite side to a support surface 9 side for supporting the recording sheet S of the platen 8A. In the platen 8A, multiple slits 9*a* which are open on the support surface 9 are formed along the carriage shaft 3 at predetermined intervals.

The temperature setting position R according to the embodiment is a position opposing to the platen 8A and the platen heater 20. More specifically, the temperature setting position R is configured to have a region opposing the support surface 9 of the platen 8A and a region opposing the platen heater 20 through the slits 9*a*.

In this manner, a position directly opposing the platen heater 20 in which the head 1 is not blocked by the platen 8A is also included in the temperature setting position R.

Third Embodiment

Figure 10:
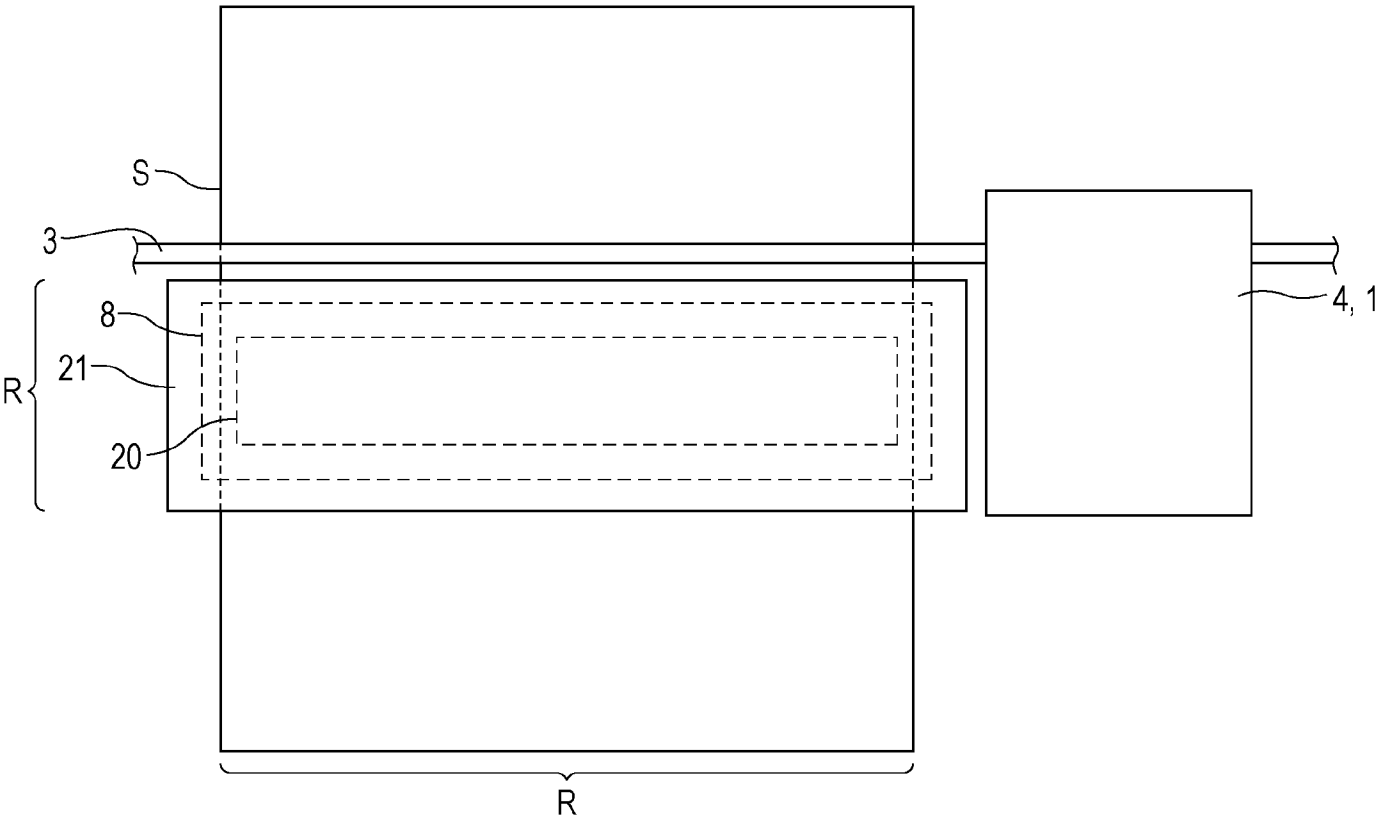
FIG. 10 is a top view illustrating a configuration of a heating unit according to a third embodiment.

In the embodiment, further another embodiment of the temperature setting position R will be described. FIG. 10 is a top view illustrating a configuration of a heating unit. The same reference numerals are given to the same elements as those of the first embodiment, and the description thereof will not be repeated.

As illustrated in FIG. 10, the heating unit according to the embodiment is similar to that of the first embodiment. The temperature setting position R according to the embodiment is a position opposing a region where the recording sheet S having the maximum size which enables the ink to be ejected in the ink jet recording apparatus I occupies the platen 8. The region where the recording sheet S occupies the platen 8 is a region where the recording sheet S and the platen 8 are overlapped with each other in a top view. However, in the region, it does not matter whether or not the recording sheet S is actually supported by the platen 8. That is, the region may be a region where the recording sheet S and the platen 8 are overlapped with each other when the recording sheet S is placed on the platen 8.

The recording sheet S is supported at a position to which the heat radiated from the platen 8 heated by the platen heater 20 is efficiently transferred. Accordingly, it is possible to efficiently heat the head 1 by setting the temperature setting position R as described above.

In this manner, a position where the head 1 opposes the region in which the platen 8 and the recording sheet S are overlapped with each other is also included in the temperature setting position R.

The temperature setting position R is not limited to those described in the first to third embodiments, as long as the temperature setting position R is a position to where the heat radiated from the temperature setting unit is transferred.

Fourth Embodiment

In the first embodiment, the printing is started after the head 1 is moved and heated, but is not limited to this process. For example, after the head 1 is heated, a flushing operation may be performed.

Figure 11:
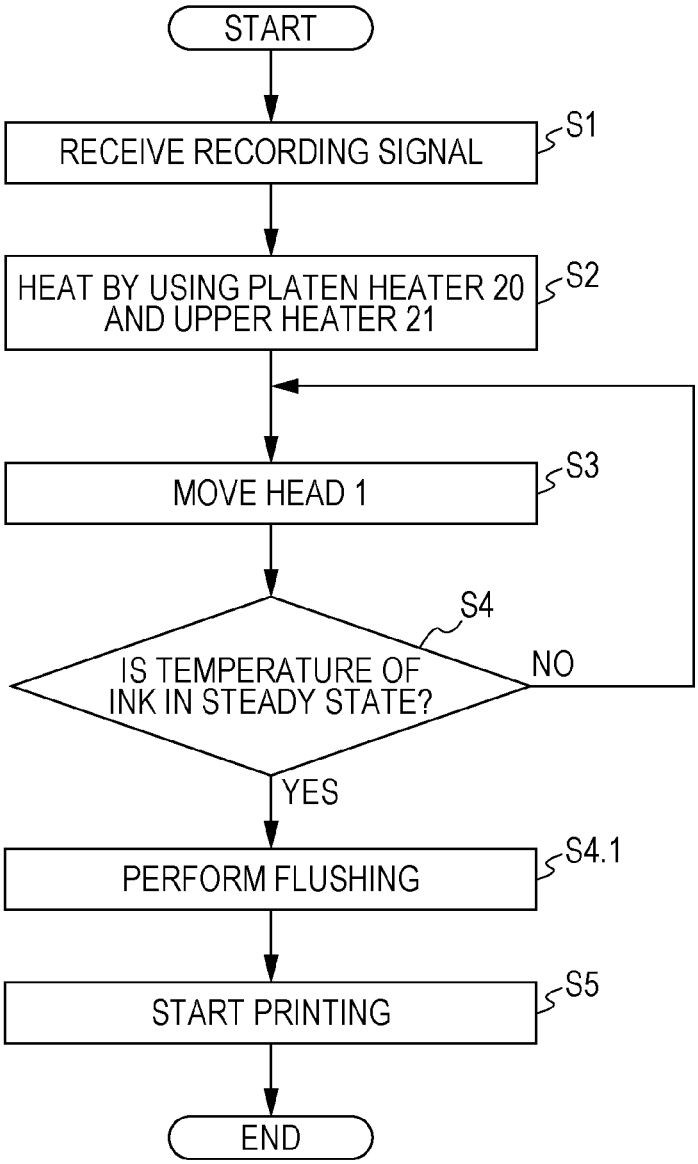
FIG. 11 is a flowchart illustrating an operation of a recording apparatus according to a fourth embodiment.

FIG. 11 is a flowchart illustrating an operation of the ink jet recording apparatus according to the embodiment. The same reference numerals are given to the same elements as those of the first embodiment, and the description thereof will not be repeated.

Similar to the first embodiment, the controller 100 causes the heating unit to heat the head 1 (steps S1 to S4).

Next, the controller 100 performs flushing (step S4.1).

The flushing is a preliminary ejecting operation which causes the head 1 to eject ink droplets in the non-printing region such as the home position. The flushing is performed to solve a problem that the viscosity of the ink is increased due to a temperature change in the ink which is caused by a change in the surrounding environmental temperature and thus clogging occurs in the nozzle openings 56. Normally, the flushing is performed prior to the printing start or during the printing. More specifically, the controller 100 moves the head 1 onto the cap member 22 of the home position. Then, the controller 100 applies the drive signal for the flushing to the head 1, and causes the head 1 to eject the ink droplets.

In the ink jet recording apparatus I according to the embodiment, since the head 1 is heated prior to the flushing, the viscosity of the ink is decreased. Therefore, it is possible to more reliably discharge the ink by using the flushing operation. In addition, since the viscosity of the ink is decreased, it is also possible to reduce a discharge amount of the ink.

After this flushing, the printing is started similar to the first embodiment (step S5).

Fifth Embodiment

In the first embodiment, the printing is started after the head 1 is moved and heated, but is not limited to this process. For example, after the head 1 is heated, the head 1 may be driven by using a micro-vibration waveform.

Figure 12:
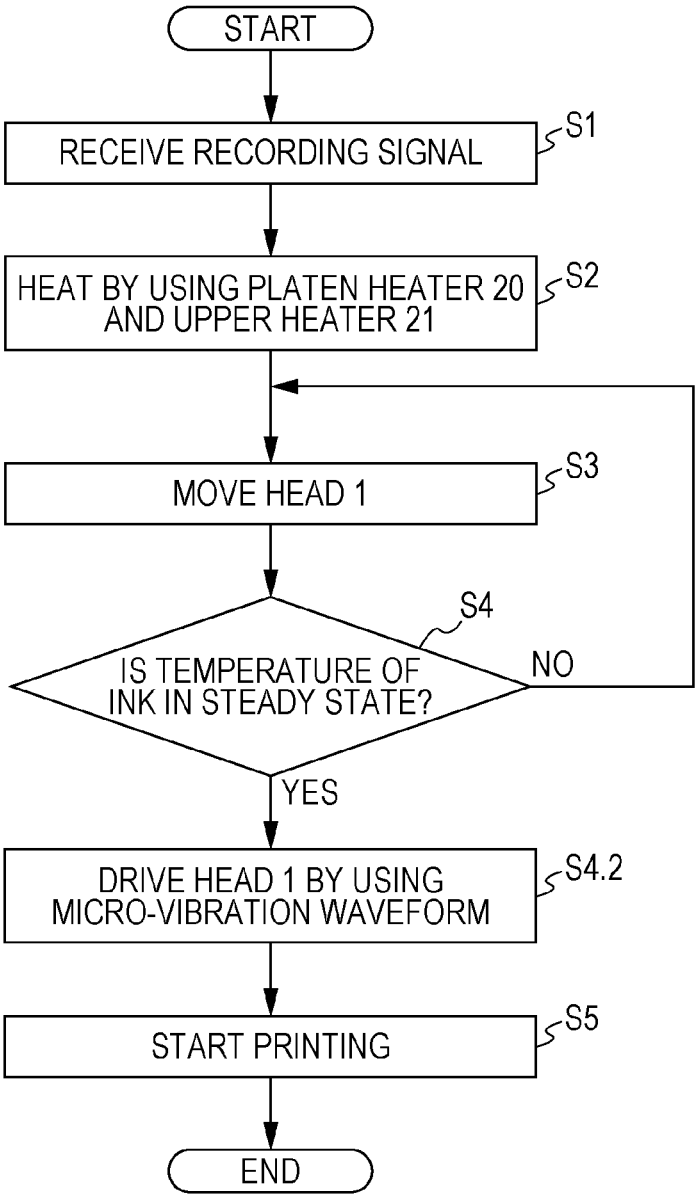
FIG. 12 is a flowchart illustrating an operation of a recording apparatus according to a fifth embodiment.

FIG. 12 is a flowchart illustrating an operation of the ink jet recording apparatus according to the embodiment. The same reference numerals are given to the same elements as those of the first embodiment, and the description thereof will not be repeated.

Similar to the first embodiment, the controller 100 causes the heating unit to heat the head 1 (steps S1 to S4).

Next, the controller 100 drives the head 1 by using the micro-vibration waveform (step S4.2). The micro-vibration waveform means a waveform which vibrates the head 1 to such an extent that an ink meniscus formed in the nozzle opening 56 is not ejected as the ink droplets.

Depending on types of ink, in some cases, components of the ink are precipitated inside the flow path of the head 1. If the components remain precipitated, there is a possibility of clogging in the nozzle openings 56. In addition, the components of the ink are uneven, thereby degrading printing quality. In order to solve this problem, the head 1 is generally driven by using the micro-vibration waveform prior to the printing start or during the printing. More specifically, the controller 100 moves the head 1 onto the cap member 22 of the home position. Then, the controller 100 applies the micro-vibration waveform to the head 1, and vibrates the ink meniscus of the nozzle opening 56. This vibration agitates the ink inside the flow path to suppress the precipitation of the ink components, thereby enabling the printing quality to be improved.

In the ink jet recording apparatus I according to the embodiment, the head 1 is heated before the head 1 is driven by using the micro-vibration waveform, thereby decreasing the viscosity of the ink. Therefore, it is possible to more excellently agitate the ink inside the flow path by using the vibration of the meniscus which is generated by the micro-vibration waveform. In this manner, it is possible to further improve the printing quality by suppressing the precipitation of the ink components inside the flow path.

After the head 1 is driven by using the micro-vibration waveform as described above, the printing is started similar to the first embodiment (step S5).

Sixth Embodiment

In the first embodiment, the printing is started after the head 1 is moved and heated, but is not limited to this process. For example, after the head 1 is heated, the ink inside the head 1 may be absorbed.

Figure 13:
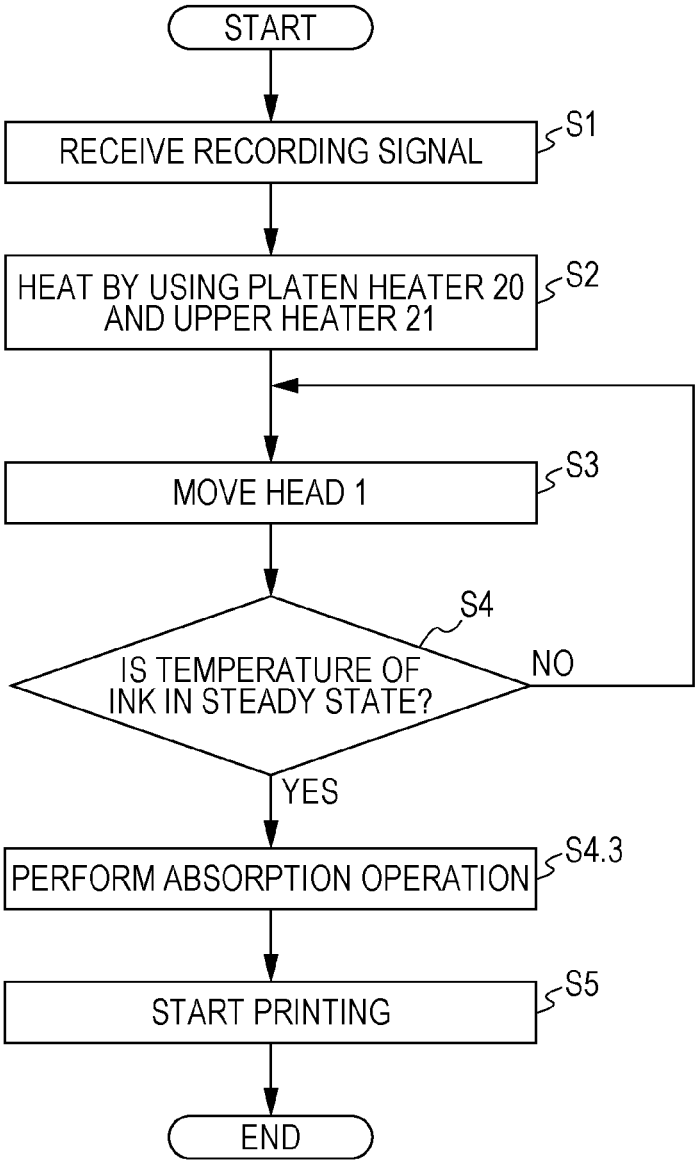
FIG. 13 is a flowchart illustrating an operation of a recording apparatus according to a sixth embodiment.

FIG. 13 is a flowchart illustrating an operation of the ink jet recording apparatus according to the embodiment. The same reference numerals are given to the same elements as those of the first embodiment, and the description thereof will not be repeated.

Similar to the first embodiment, the controller 100 causes the heating unit to heat the head 1 (steps S1 to S4). Next, the controller 100 performs absorption of the ink inside the head 1 (step S4.3).

The absorption of the ink means an operation in which the ink is absorbed from the nozzle openings 56 of the head 1. That is, the ink is absorbed from the nozzle openings 56 and the ink is allowed to have a faster flow speed than a flow speed of when the ink is normally ejected. In this manner, the absorption is an operation in which air bubbles or foreign substances in the flow path are discharged outward from the ink and the nozzle openings 56.

More specifically, the controller 100 moves the head 1 onto the cap member 22 of the home position, and causes the cap member 22 to seal the nozzle openings 56. Then, the controller 100 causes an absorption unit to perform an absorption operation for internally absorbing the cap member 22. In this manner, the air bubbles and the foreign substances of the head 1 are discharged together with the ink, thereby suppressing the clogging of the nozzle openings 56 or occurrence of ejection failures such as missing dots.

In the ink jet recording apparatus I according to the embodiment, the head 1 is heated before the absorption operation is performed, thereby decreasing the viscosity of the ink. Therefore, it is possible to facilitate the discharge of the ink by using the absorption operation. In this manner, it is possible to improve the printing quality by more reliably removing the air bubbles or the foreign substances contained in the ink inside the flow path.

After the head 1 is driven by using the micro-vibration waveform as described above, the printing is started similar to the first embodiment (step S5).

Seventh Embodiment

In the first embodiment, the printing is started after the head 1 is moved and heated, but is not limited to this process. For example, after the head 1 is heated, the nozzle plate 57 of the head 1 may be cleaned.

Figure 14:
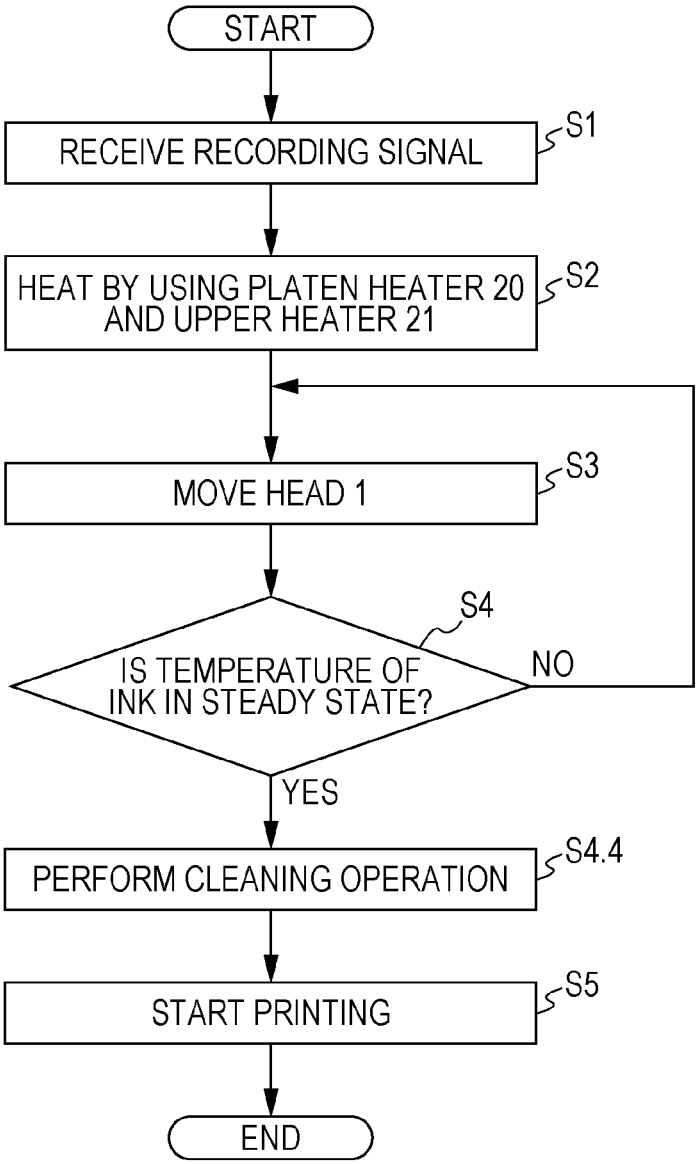
FIG. 14 is a flowchart illustrating an operation of a recording apparatus according to a seventh embodiment.

FIG. 14 is a flowchart illustrating an operation of the ink jet recording apparatus according to the embodiment. The same reference numerals are given to the same elements as those of the first embodiment, and the description thereof will not be repeated.

Similar to the first embodiment, the controller 100 causes the heating unit to heat the head 1 (steps S1 to S4).

Next, the controller 100 performs cleaning of the nozzle plate 57 of the head 1 (step S4.4).

For example, although not particularly illustrated, a wiping unit is disposed in the ink jet recording apparatus I. The wiping unit wipes and removes ink droplets or foreign substances adhering to a surface of the nozzle plate 57 of the head 1. For example, the wiping unit includes a wiper member for wiping the nozzle plate 57 and a movable mechanism for moving the wiper member.

The controller 100 moves the head 1 to the wiping unit after heating the head 1. Then, the controller 100 causes the wiper member of the wiping unit to clean the surface of the nozzle plate 57.

In the ink jet recording apparatus I according to the embodiment, the head 1 is heated before the cleaning operation is performed by the wiping unit. Accordingly, it is possible to soften the ink droplets adhering to the surface of the nozzle plate 57. Therefore, it is possible to more effectively wipe out the ink by using the wiping unit. In this manner, it is possible to reduce contamination caused by the ink droplets adhering to the recording sheet S by more reliably removing the ink adhering to the nozzle plate 57.

After the head 1 is driven by using the wiping unit as described above, the printing is started similar to the first embodiment (step S5).

Another Embodiment

Hitherto, the embodiments of the invention have been described, but a basic configuration of the invention is not limited to the above embodiments. The above-described embodiments may be combined with one another, or may be combined with one or more modification examples described below.

For example, the heating unit is configured to have the platen heater 20 and the upper heater 21, but the embodiment is not limited thereto. As long as the head 1 can be heated (temperature setting is available), the embodiment is not particularly limited.

In addition, the pressure generation unit that generates the pressure change in the pressure generation chamber 52 is not limited to the pressure generation unit described in the first embodiment. For example, it is possible to use those which eject ink droplets from the nozzle by arranging a heating element inside a liquid flow path and using bubbles generated by heating of the heating element, or a so-called electrostatic actuator which ejects the ink droplets from the nozzle by generating an electrostatic force between the vibration plate and the electrode and deforming the vibration plate by means of the electrostatic force.

The ink jet recording apparatus I adopts a configuration where the ink cartridge 5 together with head 1 is mounted on the carriage 4, that is, a so-called on-carriage type. However, the ink jet recording apparatus I may adopt a configuration where the ink cartridge 5 is disposed in the apparatus body 2 and the ink is supplied from the ink cartridge 5 to the head 1 via a tube, that is, a so-called off-carriage type. In addition, the ink cartridge 5 may be arranged outside the apparatus body 2 without being necessarily disposed in the apparatus body 2 and the ink may be supplied to the head 1 via the tube or the like.

Furthermore, the invention is widely targeted at the liquid ejecting apparatuses. For example, the invention can be applied to the liquid ejecting apparatuses including recording heads such as various ink jet recording heads used in image recording apparatuses such as printers, color material ejecting heads used in manufacturing color filters such as liquid crystal displays, electrode material ejecting heads used in forming electrodes for organic EL displays, FEDs (field emission displays) and the like, and living organic material ejecting heads used in manufacturing biochips.

What is claimed is:

1. A liquid ejecting apparatus comprising:

a liquid ejecting head that ejects a liquid from a nozzle opening;

a moving unit that relatively moves the liquid ejecting head;

a temperature setting unit that has a support member supporting a recording medium onto which the liquid is ejected from the liquid ejecting head, and that sets a temperature of the support member or the recording medium supported by the support member; and a controller that drives the moving unit before the liquid ejecting head ejects the liquid onto the recording medium, that moves the liquid ejecting head to a temperature setting position where heat radiated from the temperature setting unit is transferred to the liquid ejecting head, and that uses the temperature setting unit so as to perform temperature setting on the liquid ejecting head.

2. The liquid ejecting apparatus according to claim 1, wherein a gap between a nozzle surface having the nozzle openings of the liquid ejecting head and the recording medium when the temperature setting unit performs the temperature setting on the liquid ejecting head is smaller than the gap of when the liquid ejecting head ejects the liquid onto the recording medium.

3. The liquid ejecting apparatus according to claim 1, wherein in a ratio of a time period when the liquid ejecting head stays at the temperature setting position to a time period required for one pass which represents an operation where the liquid ejecting head moves relative to the recording medium, one pass of when the temperature setting unit performs the temperature setting on the liquid ejecting head is longer than one pass of when the liquid ejecting head ejects the liquid onto the recording medium.

4. The liquid ejecting apparatus according to claim 1, wherein the liquid ejecting head is stopped at the temperature setting position when the temperature setting unit is used in performing the temperature setting on the liquid ejecting head.

5. The liquid ejecting apparatus according to claim 1, wherein the maximum speed of when the temperature setting is performed on the liquid ejecting head is slower than the maximum speed of when the liquid ejecting head relatively moves while ejecting the liquid onto the recording medium.

6. The liquid ejecting apparatus according to claim 1, wherein a first speed difference between a moving speed at the temperature setting position when the liquid ejecting head ejects the liquid and a moving speed at the temperature setting position when the temperature setting is performed on the liquid ejecting head is greater than a second temperature difference between a moving speed in a region other than the temperature setting position when the liquid ejecting head ejects the liquid and a moving speed in the region other than the temperature setting position when the temperature setting is performed on the liquid ejecting head.

7. The liquid ejecting apparatus according to claim 1, wherein the number per unit time of departures from the temperature setting position when the temperature setting is performed on the liquid ejecting head is less than the number per unit time of departures from the temperature setting position when the liquid ejecting head ejects the liquid.

8. The liquid ejecting apparatus according to claim 1, wherein the temperature setting unit includes the support member and an upper heater that is arranged to be further separated in a direction opposite to the support member than the liquid ejecting head, and that heats the support member or the recording medium supported by the support member, and wherein the temperature setting position is a position opposing the upper heater.

9. The liquid ejecting apparatus according to claim 1, wherein the temperature setting position is a position opposing the support member.

10. The liquid ejecting apparatus according to claim 1, wherein the temperature setting unit includes the support member and a heater that heats the support member from an opposite side to a support surface side which supports the recording medium of the support member, and wherein the temperature setting position is a position opposing the heater.

11. The liquid ejecting apparatus according to claim 1, wherein the temperature setting position is a position opposing a region where the recording medium having the maximum size which enables the liquid ejecting apparatus to eject the liquid occupies the support member.

12. The liquid ejecting apparatus according to claim 1, wherein the controller causes the liquid ejecting head to perform a flushing operation where the liquid is ejected from the nozzle openings, after the temperature setting is performed on the liquid ejecting head.

13. The liquid ejecting apparatus according to claim 1, wherein the controller performs micro-vibration on a meniscus of the liquid which is formed in the nozzle opening of the liquid ejecting head, after the temperature setting is performed on the liquid ejecting head.

14. The liquid ejecting apparatus according to claim 1, further comprising:

an absorption unit that absorbs the liquid from the nozzle openings of the liquid ejecting head, wherein the controller causes the absorption unit to absorb the liquid from the nozzle openings of the liquid ejecting head, after the temperature setting is performed on the liquid ejecting head.

15. The liquid ejecting apparatus according to claim 1, further comprising:

a wiping unit that wipes a nozzle surface having the nozzle openings of the liquid ejecting head, wherein the controller causes the wiping unit to wipe the nozzle surface of the liquid ejecting head, after the temperature setting is performed on the liquid ejecting head.

* * * * *